US009109795B2

(12) United States Patent
Peyron

(10) Patent No.: US 9,109,795 B2
(45) Date of Patent: Aug. 18, 2015

(54) U-TUBE VAPORIZER

(75) Inventor: Jean-Marc Peyron, Houston, TX (US)

(73) Assignee: L'Air Liquide Société Anonyme Pour L'Étude Et L'Exploitation Des Procedes Georges Claude, Paris (FR)

( * ) Notice: Subject to any disclaimer, the term of this patent is extended or adjusted under 35 U.S.C. 154(b) by 162 days.

(21) Appl. No.: 13/813,098

(22) PCT Filed: Jul. 29, 2011

(86) PCT No.: PCT/EP2011/063061

§ 371 (c)(1),
(2), (4) Date: Jan. 29, 2013

(87) PCT Pub. No.: WO2012/016915

PCT Pub. Date: Feb. 9, 2012

(65) Prior Publication Data

US 2013/0125839 A1 May 23, 2013

(30) Foreign Application Priority Data

Aug. 2, 2010 (FR) ..... 10 56376

(51) Int. Cl.

| | |
|---|---|
| ***F22B 7/16*** | (2006.01) |
| ***F28D 7/06*** | (2006.01) |
| ***F28F 9/02*** | (2006.01) |
| ***F25J 5/00*** | (2006.01) |

(Continued)

(52) U.S. Cl.

CPC ... *F22B 7/16* (2013.01); *F28D 7/06* (2013.01); *F28F 9/02* (2013.01); *F28F 9/0265* (2013.01); *F28D 2021/0064* (2013.01); *F28D 2021/0071* (2013.01)

(58) Field of Classification Search

None

See application file for complete search history.

(56) References Cited

U.S. PATENT DOCUMENTS 2,995,341 A * 8/1961 Danesi ..... 165/110
3,213,833 A * 10/1965 Cunningham et al. ..... 122/34

(Continued)

FOREIGN PATENT DOCUMENTS

| | | |
|---|---|---|
| DE | 4120800 | 1/1993 |
| EP | 0042028 | 12/1981 |

(Continued)

OTHER PUBLICATIONS

PCT/EP2011/063061, International Search Report and Written Opinion, Nov. 14, 2011.

*Primary Examiner* — Steven B McAllister
*Assistant Examiner* — Eric Gorman
(74) *Attorney, Agent, or Firm* — Justin K. Murray

(57) ABSTRACT

A vaporizer includes a plurality of U-shaped tubes contained in a vessel and are arranged in at least one plane. The vessel is closed at one end by a plate having openings adapted to mate with the end of the U-shaped tubes, and there is a dome covering the plate on the opposite side of the tubes. The dome is bounded by a wall forming an inlet chamber and an outlet chamber, the inlet chamber being split into two parts by a partition perpendicular to the plane of the tubes and to the wall to form a chamber for admitting liquid between the plate and the partition and an auxiliary chamber on the other side of the partition. The auxiliary chamber is configured to receive liquid from the admission chamber such that liquid from the outside arriving in the admission chamber enters the tubes via the bottom openings only.

19 Claims, 2 Drawing Sheets

(51) Int. Cl.

| | |
|---|---|
| ***F25B 33/00*** | (2006.01) |
| ***F25J 3/06*** | (2006.01) |
| ***F28B 1/02*** | (2006.01) |
| *F28D 21/00* | (2006.01) |

(56) References Cited

U.S. PATENT DOCUMENTS

| | | | | | |
|---|---|---|---|---|---|
| 3,545,536 | A | * | 12/1970 | Perrin et al. | 165/134.1 |
| 3,568,764 | A | | 3/1971 | Newman et al. | |
| 3,759,319 | A | * | 9/1973 | Ritland et al. | 165/111 |
| 3,889,641 | A | * | 6/1975 | Mayer et al. | 122/32 |
| 3,907,029 | A | * | 9/1975 | Klein et al. | 165/161 |
| 3,996,897 | A | * | 12/1976 | Herzog | 122/483 |
| 4,167,968 | A | * | 9/1979 | Wietelmann | 165/278 |
| 4,223,722 | A | * | 9/1980 | Shade, Jr. | 165/111 |
| 4,305,548 | A | * | 12/1981 | Miner et al. | 237/67 |
| 4,383,643 | A | * | 5/1983 | Sohn | 237/60 |
| 4,396,508 | A | * | 8/1983 | Broughton | 210/187 |
| 4,401,153 | A | * | 8/1983 | Marsch et al. | 165/134.1 |
| 4,650,503 | A | * | 3/1987 | Juzi | 96/189 |
| 4,664,754 | A | * | 5/1987 | Caputi et al. | 203/39 |
| 4,863,497 | A | * | 9/1989 | Grenier et al. | 96/123 |
| 5,028,381 | A | * | 7/1991 | Dugue | 376/252 |
| 5,100,610 | A | * | 3/1992 | Pirl et al. | 376/260 |
| 5,224,351 | A | * | 7/1993 | Jeannot et al. | 62/643 |
| 5,245,843 | A | * | 9/1993 | Shimoya et al. | 62/515 |
| 5,390,507 | A | * | 2/1995 | Shimoya et al. | 62/200 |
| 6,161,613 | A | * | 12/2000 | Huenniger | 165/145 |
| 6,543,252 | B1 | * | 4/2003 | Fuentes et al. | 62/643 |
| 7,185,698 | B1 | * | 3/2007 | Bernert et al. | 165/135 |
| 7,384,539 | B2 | * | 6/2008 | Witte | 208/107 |
| 2006/0266504 | A1 | | 11/2006 | Rohrbaugh et al. | |
| 2008/0202735 | A1 | * | 8/2008 | Geskes et al. | 165/166 |
| 2009/0064821 | A1 | * | 3/2009 | La Sorda et al. | 75/709 |
| 2009/0242377 | A1 | * | 10/2009 | Honkola et al. | 201/37 |
| 2009/0288520 | A1 | * | 11/2009 | La Sorda | 75/709 |
| 2012/0103137 | A1 | * | 5/2012 | La Sorda | 75/709 |
| 2013/0025415 | A1 | * | 1/2013 | La Sorda et al. | 75/709 |

FOREIGN PATENT DOCUMENTS

| | | |
|---|---|---|
| EP | 0856714 | 8/1998 |
| JP | 2005249314 | 9/2005 |

* cited by examiner

PRIOR ART

U-TUBE VAPORIZER

CROSS REFERENCE TO RELATED APPLICATIONS

This application is a §371 of International PCT Application PCT/EP2011/063061, filed Jul. 29, 2011, which claims the benefit of FR1056376, filed Aug. 2, 2010, both of which are herein incorporated by reference in their entireties.

TECHNICAL FIELD OF THE INVENTION

The present invention relates to a vaporizer. In particular, it relates to a vaporizer having a heat exchanger in which a heat-generating fluid gives up heat to a liquid to be vaporized, the liquid circulating in at least one U-shaped tube coupled to a plate. This vaporizer may, for example, be a standby vaporizer, which vaporizes cryogenic liquid toward a network, in order to compensate the flow rate coming from a cryogenic unit.

BACKGROUND

This system is generally supplied by a cryogenic pump and the liquid vaporized in the hairpin is sent toward the client when the air separation unit is stopped.

Thus, in FIG. 1, a vaporizer 4 can be seen which consists of a cylindrical vessel 7 and a hemispherical dome, the two being separated by a vertical plate 13 pierced with openings. These openings are linked to U-shaped pipes so that one end of the pipe is attached to an opening in the bottom part of the vertical plate 13 and the other end is attached to an opening in the top part of this plate. The dome is divided in a seal-tight manner into a top part 5 (i.e., exhaust chamber) and a bottom part 3 (i.e., intake chamber) by a horizontal planar plate forming a wall 6. A liquid to be vaporized 1 is introduced into the bottom part 3 which forms a supply chamber and circulates in U-shaped tubes 17. Some of the tube openings in the plate 13 are higher than others, so that the liquid reenters into the tubes at different levels. The liquid arrives toward the top part 5 of the dome 2 which constitutes an exhaust chamber. There, it is entirely vaporized by virtue of the heat exchange with steam 9 or other heat-generating gas sent into the vessel 7 and which circulates around the tube or tubes 17. The gas formed 15 by vaporizing the liquid is drawn from the top part 5 of the dome 2. The cooled steam 11 leaves into the atmosphere at the top of the vessel 7.

This vaporization system has a relatively lengthy start-up time; even when the cryogenic pump is sending the full flow rate toward this standby system, there is a wait of between 30 seconds and one minute before the full vaporization flow rate is observed.

This delay does not present a drawback in methods where a buffer vessel containing gas ensures the transitional flow rate between the shutdown of the unit and full production of the vaporization system. However, this type of buffer vessel is expensive, especially when the operating pressures are high.

A finer analysis of this response time shows a linear response of the production flow rate as a function of time on production ramp-up, but also on production ramp-down. From this curve, we can deduce that the response of the system is very strongly correlated to the liquid inertia of the bottom part 3. In practice, the production of the vaporizer will be maximum when all the tubes 17 are supplied, therefore when the supply shell 3 is filled with liquid.

SUMMARY OF THE INVENTION

One aim of the invention is to reduce the start-up time of a vaporizer and to reduce the overall cost of the apparatus incorporating the vaporizer by eliminating or by reducing the size of the buffer vessels.

According to one subject of the invention, a vaporizer is provided comprising a plurality of U-shaped tubes contained in a vessel, each tube having two ends, the tubes being arranged in at least one plane, the vessel being closed on one side by a plate that has as many openings as there are tube ends, the openings comprising top openings and bottom openings, each tube being linked by a top end to a top opening of the plate and by a bottom end to a bottom opening of the plate, a dome covering the plate on the side opposite to that of the tubes, the dome being delimited by a wall orthogonal to the plane of the tubes to form an intake chamber and an exhaust chamber, characterized in that the intake chamber is divided into two parts by a partition at right angles to the plane of the tubes and to the wall to form a liquid inlet chamber between the plate and the partition and an auxiliary chamber on the other side of the partition, the liquid inlet originating from the outside of the vaporizer opening into the inlet chamber and the auxiliary chamber being arranged to receive only liquid originating from the inlet chamber so that the liquid originating from the outside arriving in the inlet chamber enters into the tubes through the bottom openings only.

According to other optional aspects:

- the partition comprises an opening toward its bottom edge to allow for a circulation of liquid between the partition and the dome,
- a space is formed between the end of the partition and the wall,
- the volume of the inlet chamber is smaller than that of the auxiliary chamber,
- the volume of the inlet chamber is at least two times smaller than that of the auxiliary chamber,
- the bottom openings are arranged at different distances from the wall,
- the branches of the tubes are arranged in horizontal planes,
- the vaporizer comprises a heat-generating fluid intake opening into the vessel,
- the intake chamber and the exhaust chamber have substantially the same shape and the same volume,
- the wall is a planar plate,
- in use, the liquid originating from the outside can penetrate into the auxiliary chamber only by passing through an opening in the partition or by passing over the partition,
- the liquid inlet is formed in the vessel,
- the liquid inlet is arranged so that, in use, the liquid reenters through the bottom of the vaporizer.

According to another subject of the invention, a cryogenic distillation separation apparatus is provided comprising a vaporizer as claimed in one of the preceding claims and means for supplying it with cryogenic liquid.

According to another subject of the invention, a method for vaporizing a liquid in a vapor as described in any of the embodiments herein is provided, in which a heat-generating gas is sent to the vessel, a liquid to be vaporized is introduced into the inlet chamber and the vaporized liquid is discharged through the exhaust chamber.

The improvement device according to the invention is therefore an overflow system which preferentially supplies the tubes of the exchanger on production ramp-up of the vaporization system. This overflow consists of a solid plate open at the top and provided with a deconcentration hole for hydrocarbon safety situated at the lowest point of the tank.

In doing this, by reducing the distance between the spout and the inlet of the tubes, it is possible to reduce the tube supply time by a factor of 10 and therefore the standby vaporization start-up time and therefore eliminate the buffer vessels. This type of device can be applied to all liquids, in particular CO, $CO_2$, $O_2$, $N_2$, Ar, etc.

BRIEF DESCRIPTION OF THE DRAWINGS

These and other features, aspects, and advantages of the present invention will become better understood with regard to the following description, claims, and accompanying drawings. It is to be noted, however, that the drawings illustrate only several embodiments of the invention and are therefore not to be considered limiting of the invention's scope as it can admit to other equally effective embodiments.

DETAILED DESCRIPTION

Figure 2:
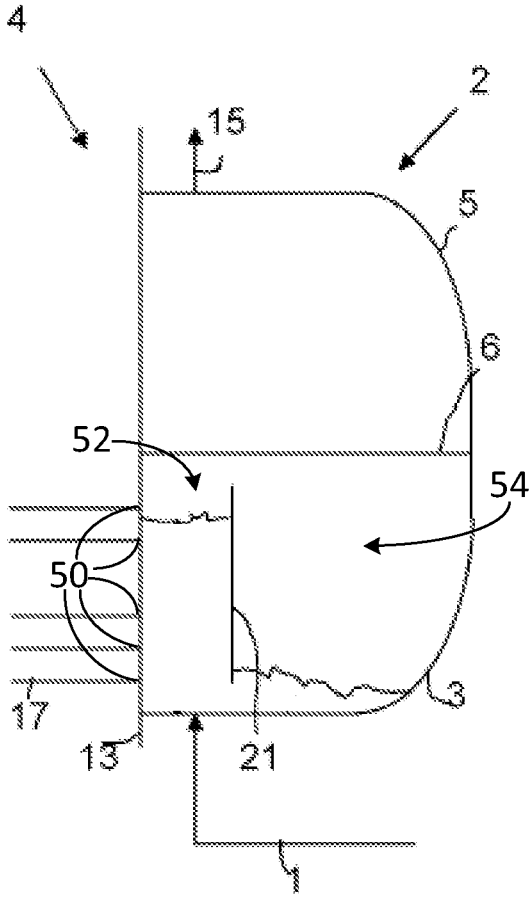
FIG. 2 represents vertical cross section of an apparatus in accordance with an embodiment of the invention.

The invention will be described in more detail by referring to FIGS. 2 and 3. FIG. 2 illustrates a vertical cross section of a vaporizer in accordance with various embodiments of the invention and FIG. 3 shows a side view of the interior of the vaporizer of FIG. 2.

Figure 1:
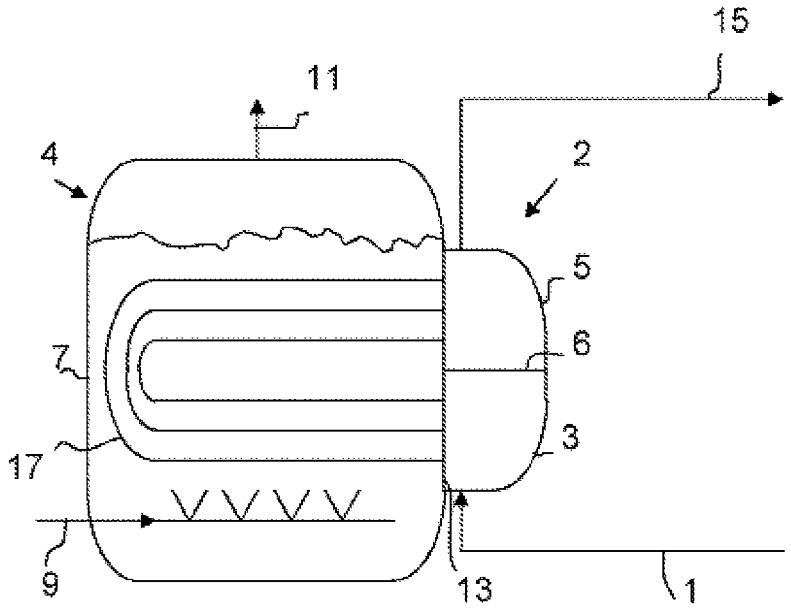
FIG. 1 represents an apparatus in accordance with an embodiment of the prior art.

The vaporizer of FIG. 2 differs from that of FIG. 1 in that a partition 21, which in one embodiment comprises a solid plate that forms a partial partition dividing the bottom part 3 of the dome 2 into two unequal parts, is included. The left-hand part of FIG. 1 corresponds to the left-hand part of the vaporizer of FIG. 2. The partition 21 is arranged substantially vertically, so that approximately a third of the volume of the bottom part 3 is located between this partition 21 and the plate 13. The partition 21 does not extend as far as the horizontal plate of the wall 6 and an opening 23 is formed in the middle of the partition 21, at its bottom edge.

In use, the liquid penetrates from the outside into the space of the bottom part 3 only through an inlet arranged between the plate 13 and the partition 21. Since the opening 23 is small, the liquid builds up in this space (i.e., inlet chamber 52) and the liquid level rises so that all the bottom openings 50 in the plate 13 are supplied with liquid. When the higher level of the partition 21 is reached, the liquid is poured to the other side of the partition 21 (i.e., auxiliary chamber 54). To avoid the build-up of impurities, such as hydrocarbons, the liquid can also pass through the opening 23.

Figure 3:
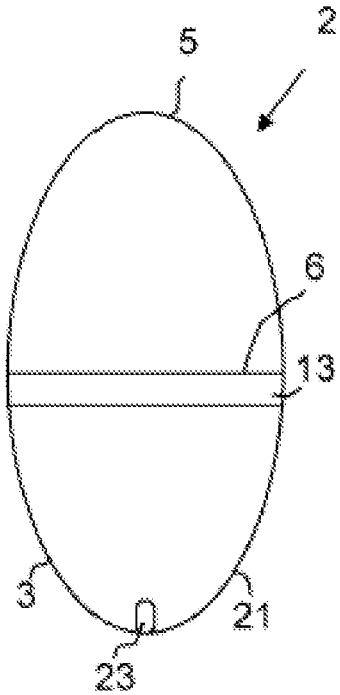
FIG. 3 represents a side view of an apparatus in accordance with an embodiment of the invention.

FIG. 3 shows the plate 13, however, the openings are not illustrated in the interests of simplification. The partition 21 has a horizontal edge and a curved edge which follows the interior of the bottom part 3 of the dome 2.

The invention also applies to the vaporization of liquids condensed at temperatures above cryogenic temperatures.

While the invention has been described in conjunction with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims. The present invention may suitably comprise, consist or consist essentially of the elements disclosed and may be practiced in the absence of an element not disclosed. Furthermore, if there is language referring to order, such as first and second, it should be understood in an exemplary sense and not in a limiting sense. For example, it can be recognized by those skilled in the art that certain steps can be combined into a single step.

The singular forms "a", "an" and "the" include plural referents, unless the context clearly dictates otherwise.

"Comprising" in a claim is an open transitional term which means the subsequently identified claim elements are a non-exclusive listing (i.e., anything else may be additionally included and remain within the scope of "comprising"). "Comprising" as used herein may be replaced by the more limited transitional terms "consisting essentially of" and "consisting of" unless otherwise indicated herein.

"Providing" in a claim is defined to mean furnishing, supplying, making available, or preparing something. The step may be performed by any actor in the absence of express language in the claim to the contrary a range is expressed, it is to be understood that another embodiment is from the one.

Optional or optionally means that the subsequently described event or circumstances may or may not occur. The description includes instances where the event or circumstance occurs and instances where it does not occur.

Ranges may be expressed herein as from about one particular value, and/or to about another particular value. When such particular value and/or to the other particular value, along with all combinations within said range.

All references identified herein are each hereby incorporated by reference into this application in their entireties, as well as for the specific information for which each is cited.

The invention claimed is:

1. A vaporizer comprising:

a vessel;

a plurality of U-shaped tubes contained in the vessel, each tube having two ends, the U-shaped tubes being arranged in at least one plane;

a plate disposed on one side of the vessel, the plate configured to close off said side of the vessel, wherein the plate has as many openings as there are tube ends, the openings comprising top openings and bottom openings, each U-shaped tube being linked by a top end to a top opening of the plate and by a bottom end to a bottom opening of the plate; and a dome covering the plate on a side opposite to that of the U-shaped tubes, the dome being delimited by a wall orthogonal to the plane of the U-shaped tubes to form an intake chamber and an exhaust chamber;

wherein the intake chamber is divided into two parts by a partition at right angles to the plane of the U-shaped tubes and to the wall to form a liquid inlet chamber between the plate and the partition and an auxiliary chamber on the other side of the partition, a liquid inlet originating from outside the vaporizer and the liquid inlet opening into the inlet chamber and the auxiliary chamber being arranged to receive only a liquid originating from the inlet chamber so that the liquid originating from the outside arriving in the inlet chamber enters into the U-shaped tubes through the bottom openings only;

wherein the partition comprises an opening toward its bottom edge to allow for a small circulation of the liquid between the partition and the dome.

2. The vaporizer as claimed in claim 1, further comprising a space disposed between the end of the partition and the wall.

3. The vaporizer as claimed in claim 1, wherein the volume of the inlet chamber is smaller than that of the auxiliary chamber.

4. The vaporizer as claimed in claim 3, wherein the volume of the inlet chamber is at least two times smaller than that of the auxiliary chamber.

5. The vaporizer as claimed in claim 1, wherein the bottom openings are arranged at different distances from the wall.

6. The vaporizer as claimed in claim 1, wherein the branches of the U-shaped tubes are arranged in horizontal planes.

7. The vaporizer as claimed in claim 1, further comprising a heat-generating fluid intake opening into the vessel.

8. The vaporizer as claimed in claim 1, wherein the intake chamber and the exhaust chamber have substantially the same shape and the same volume.

9. The vaporizer as claimed in claim 1, wherein the wall is a planar plate.

10. The vaporizer as claimed in claim 1, wherein the vaporizer is configured to only allow the liquid originating from the outside to penetrate into the auxiliary chamber by passing through an opening in the partition or by passing over the partition.

11. The vaporizer as claimed in claim 1, wherein the liquid inlet is formed in the vessel.

12. The vaporizer as claimed in claim 11, wherein the liquid inlet is arranged so that, in use, the liquid re-enters through the bottom of the vaporizer.

13. The vaporizer as claimed in claim 1, wherein the vaporizer is configured to be disposed in a cryogenic distillation separation apparatus.

14. A method for vaporizing the liquid using the vaporizer as claimed in claim 1, the method comprising the steps of:

providing the vaporizer as claimed in claim 1;

sending a heat-generating gas to the vessel;

introducing the liquid to be vaporized into the inlet chamber; and discharging the vaporized liquid through the exhaust chamber.

15. The vaporizer as claimed in claim 1, wherein the bottom openings receive liquid from the inlet chamber only.

16. The vaporizer as claimed in claim 1, wherein the bottom openings and the liquid inlet are disposed on the same side of the partition.

17. A vaporizer comprising:

a vessel;

a plurality of U-shaped tubes contained in the vessel, each tube having two ends, the U-shaped tubes being arranged in at least one plane;

a plate disposed on one side of the vessel, the plate configured to close off said side of the vessel, wherein the plate has as many openings as there are tube ends, the openings comprising top openings and bottom openings, each U-shaped tube being linked by a top end to a top opening of the plate and by a bottom end to a bottom opening of the plate;

a dome covering the plate on a side opposite to that of the U-shaped tubes, the dome being delimited by a wall to form an intake chamber and an exhaust chamber, such that the intake chamber and exhaust chamber are in fluid communication with each other via the U-shaped tubes, wherein the intake chamber is divided into two parts by a partition to form an inlet chamber and an auxiliary chamber, wherein the inlet chamber is disposed between the plate and the partition, wherein auxiliary chamber is disposed on the other side of the partition; and a liquid inlet configured to allow introduction of a liquid into the inlet chamber from an external source, wherein the auxiliary chamber is arranged to receive only the liquid originating from the inlet chamber so that the liquid entering the inlet chamber via the liquid inlet enters into the U-shaped tubes through the bottom openings only;

wherein the partition comprises an opening toward its bottom edge to allow for a small circulation of the liquid between the partition and the dome.

18. The vaporizer as claimed in claim 17, wherein the bottom openings and the liquid inlet are disposed on the same side of the partition.

19. The vaporizer as claimed in claim 17, further comprising a means for supplying the liquid inlet with a cryogenic liquid.

* * * * *